United States Patent [19]

Peter

[11] 4,333,754

[45] Jun. 8, 1982

[54] ANTI-ICING NOISE-SUPPRESSING VORTEX TUBE ASSEMBLY

[75] Inventor: Joseph E. Peter, Cincinnati, Ohio

[73] Assignee: Vortec Corporation, Cincinnati, Ohio

[21] Appl. No.: 52,347

[22] Filed: Jun. 27, 1979

[51] Int. Cl.[3] ..... F25B 9/02; F01N 1/00

[52] U.S. Cl. ..... 62/5; 181/403

[58] Field of Search ..... 62/5, 296; 181/211, 181/263, 212

[56] References Cited

U.S. PATENT DOCUMENTS

| | | | |
|---|---|---|---|
| 1,077,905 | 11/1913 | Dewey | 181/211 X |
| 2,198,258 | 4/1940 | Money | 62/296 |
| 2,858,698 | 11/1958 | Hickey | 73/861.68 |
| 3,006,160 | 10/1961 | Heidorn | 62/296 |
| 3,090,208 | 5/1963 | Munakata | 62/5 |
| 3,103,104 | 9/1963 | Shackson | 62/5 |
| 3,214,923 | 11/1965 | Palmisano et al. | 62/5 |
| 3,277,238 | 10/1966 | Sharp et al. | 62/5 X |
| 3,461,676 | 8/1969 | Toelke et al. | 62/5 |
| 3,547,222 | 12/1970 | Pickle | 181/211 |
| 3,786,643 | 1/1974 | Anderson et al. | 62/5 |
| 3,815,375 | 6/1974 | Inglis | 62/5 |
| 3,968,659 | 7/1976 | Pilcher | 62/5 |
| 3,973,396 | 8/1976 | Kronogard | 62/5 X |
| 4,026,120 | 5/1977 | Tallant | 62/5 |
| 4,064,961 | 12/1977 | Tseo | 181/222 X |

FOREIGN PATENT DOCUMENTS

| | | | |
|---|---|---|---|
| 542076 | 4/1975 | U.S.S.R. | 62/5 |

*Primary Examiner*—Daniel M. Yasich

*Attorney, Agent, or Firm*—Tilton, Fallon, Lungmus

[57] ABSTRACT

A vortex tube assembly having a muffler at the cold air outlet for suppressing the noise of cold air discharged from that outlet, the muffler being warmed to a limited extent, and thereby protected against icing, by directing air from the hot air outlet into heat-exchanging relation with respect to said muffler.

11 Claims, 4 Drawing Figures

ANTI-ICING NOISE-SUPPRESSING VORTEX TUBE ASSEMBLY

BACKGROUND

In the typical industrial uses of vortex tubes, compressed air is supplied as the source of power. Such air is usually pressurized in the 80 to 100 psig range and, although filtered, is not subject to any special drying procedures. As a result, compressed air entering such a vortex tube is usually saturated with water vapor in an amount equal to the saturation level for the temperature and pressure of the compressed air supply.

Within such a vortex tube, the compressed air is throttled through nozzles and lowered to approximately atmospheric pressure. (For a discussion of counterflow vortex tubes and their method of operation, reference may be had to Fulton U.S. Pat. Nos. 3,173,273 and 3,208,229, and Ranque patent 1,952,281.) As a result of the throttling process, the air spins very rapidly and undergoes special temperature change effects which are the unique characteristics of a vortex tube. Usually a vortex tube is used for the cold air produced, and in most cases approximately 60% of the air will exit from the cold air outlet of the tube. This air, having lost its pressure, undergoes a temperature change and leaves the vortex tube at very low temperatures. Typical temperatures range from minus 40° F. to plus 20° F.

The first process, that of lowering pressure, tends to increase the capacity of the air to hold water vapor. Therefore, the compressed air which enters the vortex tube at 100% relative humidity (a saturated condition) leaves the nozzles at less than 100% relative humidity. The second process, that of cooling the air, tends to reduce the capacity of the air to hold moisture.

In the vast majority of all vortex tube applications, the second effect is stronger than the first effect. Therefore, the net result of the two processes (lowering pressure and then lowering temperature) is to reduce the ability of the compressed air to hold moisture. Because of this situation, moisture is nearly always condensed in conventional vortex tube applications and, because the exit temperature of the cold air is usually well below 32° F., that condensed moisture appears not as a liquid but as a finely-divided snow or ice.

In many vortex tube applications, the cold air must travel through associated elements or equipment before it is used. In particular, since the high-velocity cold air stream discharged from a vortex tube frequently exhibits a raucous, unpleasant noise, sometimes even a screeching or whistling sound, efforts have been made to provide sound-suppressing mufflers which may be coupled to the cold air outlets of such tubes. Unfortunately, conventional muffler designs are at best only partially effective, not because they are incapable of suppressing noise but because they tend to become clogged with ice, thereby blocking the continued flow of cold air. If, for example, a glass fiber muffler were used with a vortex tube having a cold air discharge temperature well below 32° F., the fine ice content in the cold air would tend to block the small passages in the packed muffler, ultimately freezing into a solid mass which might totally obstruct the flow of cold air. While mufflers with straight-through passages, some having re-entrant tubes, reflecting chambers, and the like, may be less susceptible to icing and clogging, they are less effective than packed mufflers in suppressing noise. Where a vortex tube requires continuous or extended use, or where the cold air fraction discharged from the tube is at the lower part of the typical range given above, even a straight-through muffler may become blocked with frozen moisture.

In some vortex tube applications where muffler icing would be expected to occur, one solution has been to install a central air dryer for removing moisture from the compressed air supplied to the vortex tubes. Such a system is expensive not only to acquire but also to maintain, with the result that some of the advantages of utilizing vortex tubes as industrial cooling devices may be substantially offset. Another approach, especially for use in plants without central compressed air dryers, is to equip the air supply lines to the vortex tubes with antifreeze injectors. (See "Cold Air Coolant Systems," (a technical brochure), p. 4, 1976, Vortec Corporation.) An antifreeze such as ethylene glycol is injected into the air stream to produce an antifreeze mist. While such a mist is effective in preventing icing of the muffler-equipped vortex tubes, the inclusion of an antifreeze injector in the system adds a further complexity and, more importantly, would be unacceptable in those instances where even traces of antifreeze on the work product would be objectionable.

SUMMARY

A main object of this invention is to provide a vortex tube assembly which is equipped with a noise suppressor or muffler at its cold air outlet and which, at the same time, requires neither an air dryer nor an antifreeze mist injector to prevent muffler icing. In that connection, it is a specific object to provide a simple, compact, relatively inexpensive, and maintenance-free solution to the icing problem.

In brief, the assembly of this invention includes a vortex tube having a generator body with a compressed air inlet and having a hot air outlet and an oppositely-directed cold air outlet, and a muffler disposed at the cold air outlet for suppressing the noise of high-velocity cold air discharged from that outlet. The assembly also includes hot air transfer means which communicates with the hot air outlet for transmitting at least a portion of the hot air in a reverse direction towards the muffler, the transfer means being in thermal exchange relation with the muffler to prevent icing which might otherwise occur and block the passages of the muffler. The invention includes not only the assembly but the method of operation of that assembly.

In one form of the assembly, the hot air transfer means comprises a heat-conductive tubular casing which extends about the vortex tube and which merges with the outer shell of the muffler. One or more discharge ports are formed in the wall of the casing for the discharge of hot air. In another form, the casing extends about the sides of the muffler, defining an annular chamber therebetween for conveying hot air into contact with the sides of the muffler before that hot air is discharged through a suitable exhaust port. In both embodiments, hot air discharged from the hot air outlet of the vortex tube is diverted and then directed into heat exchanging relation with respect to the muffler to an extent sufficient for preventing muffler icing without causing excessive heating of the muffler.

Other advantages, features, and objects of the invention will become apparent from the specification and drawings.

DRAWINGS

DETAILED DESCRIPTION

Figure 1:
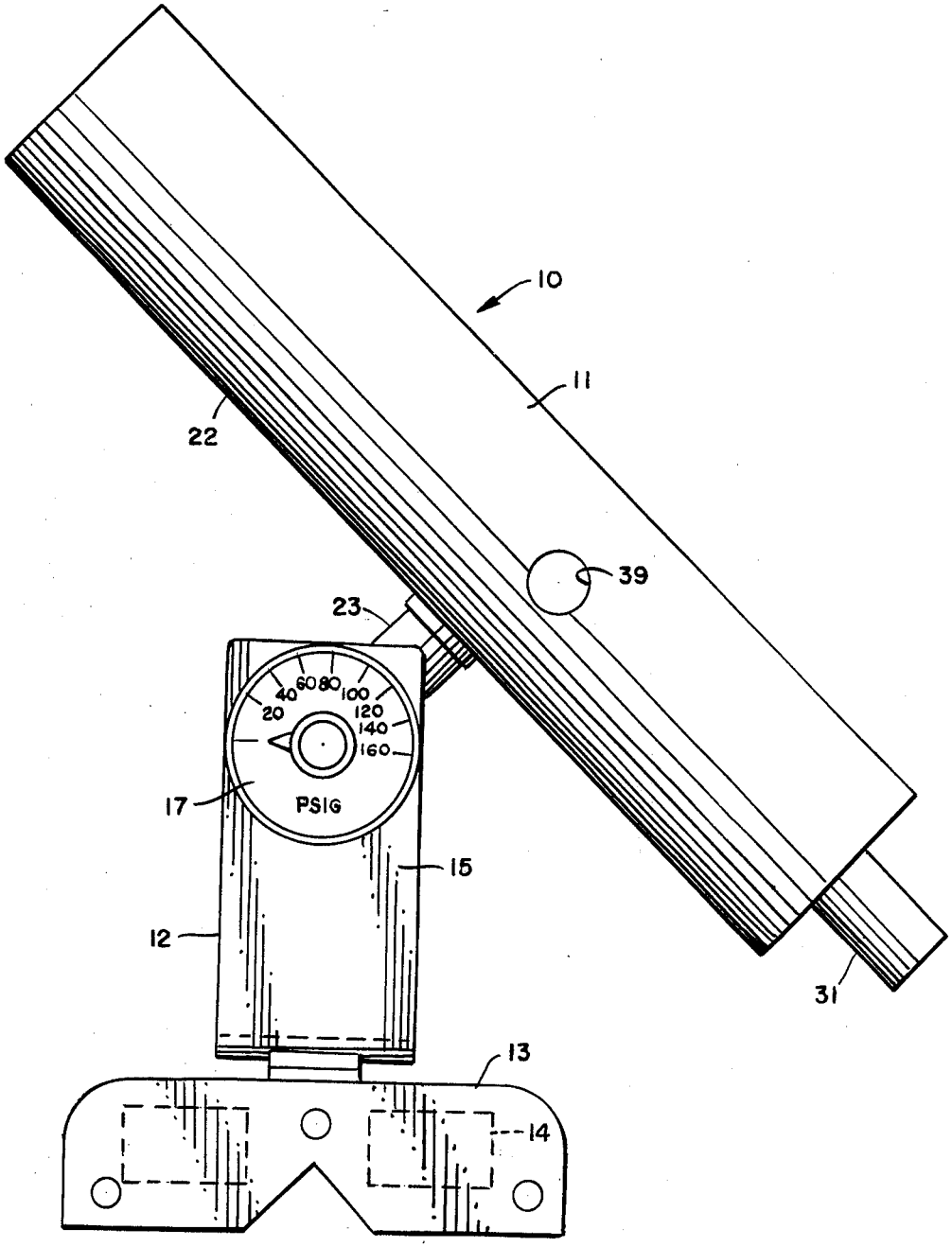
FIG. 1 is a side elevational view of a cooling device equipped with the anti-icing vortex tube assembly of the present invention.

Referring to the drawings, the numeral 10 generally designates a device comprising a vortex tube assembly 11 supported by a stand 12. The stand has a base portion 13 adapted to rest upon a support surface, such as the metal bed or table of a drill press, grinder, or milling machine, and is equipped with magnets 14 for the purpose of holding the device in a selected position of adjustment. The stand also includes an upstanding bracket 15 which has its lower end secured to the base, and a connector 16 and pressure gauge 17 joined in a manner which permits the connector 16 to be rotated about its horizontal axis so that the vortex tube assembly 11 may be pivoted into any of a wide variety of angular positions. More specifically, the cylindrical connector 16 includes an internally and externally threaded stem 16*a* which extends through an opening in bracket 15 and which is received by an internally-threaded mounting ring 18 on the opposite side of that bracket; hence, by loosening and then retightening the ring, the angle of the vortex tube assembly may be adjusted and the tube then fixed in its adjusted position. A tubular neck 17*a* of the gauge is threadedly received within the stem 16*a* and is in flow communication with connector 16.

Line 19 communicates with a source 20 of pressurized air or other gas and is coupled by nut 21 to a second threaded axial stem 16*b* of connector 16. The pressure of the compressed air is registered by gauge 17, the normal pressure for shop lines falling generally within the range of about 80 to 120 psig.

Figure 2:
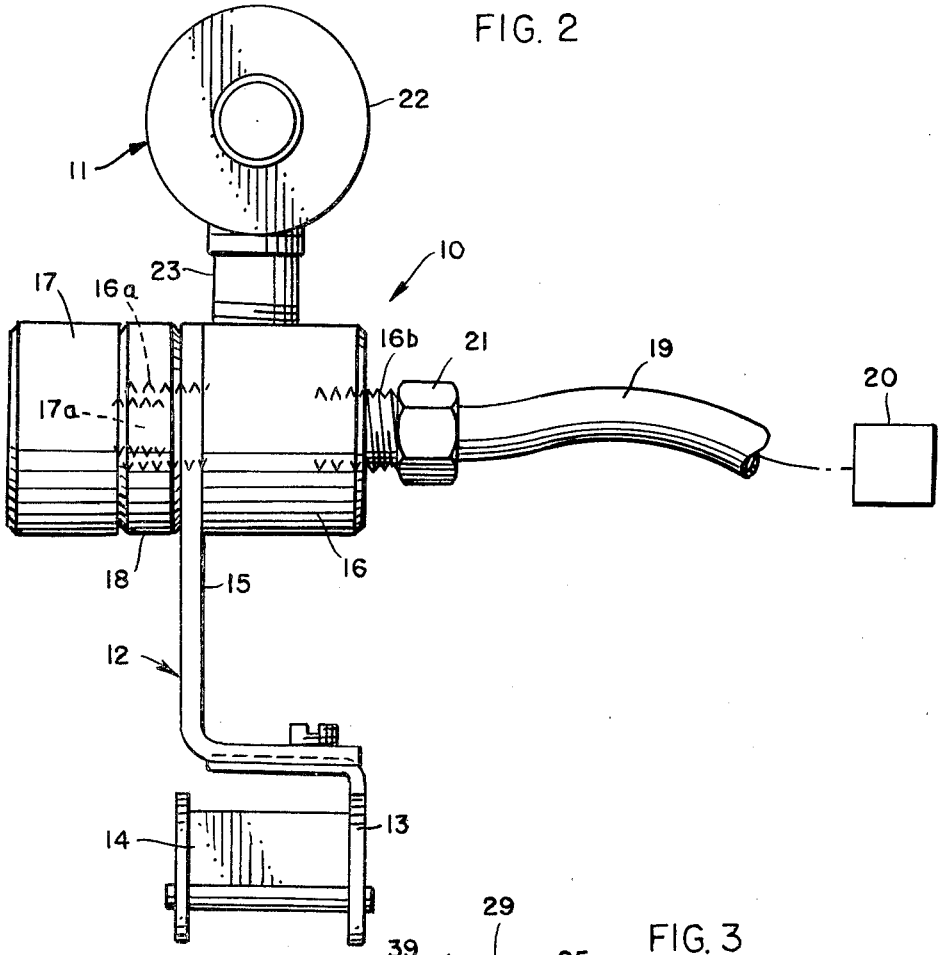
FIG. 2 is a front view of the device.

The vortex tube assembly 11 includes a generally cylindrical outer casing 22 having an inlet fitting 23 projecting from the underside thereof, the fitting being secured to and projecting radially from connector 16 as shown most clearly in FIG. 2. The inlet fitting communicates at its upper end with a vortex tube 24 disposed within casing 22. The vortex tube may be entirely conventional in construction and includes a cylindrical generator body 24*a*, a tubular hot air outlet 24*b* coaxial with the body and projecting from one end thereof, and a tubular cold air outlet 24*c* also coaxial with the body and projecting from the opposite end thereof. Reference may be had to the aforementioned patents for details concerning the construction and operation of the vortex tube 24. For purposes of fully disclosing the present invention, it is believed sufficient to state that vortex tube 24 operates to divide a stream of compressed air (or other gas) entering the body of the tube through inlet 23 into hot and cold fractions, the hot fraction being discharged axially from the free end of outlet tube 24*b* and the cold fraction being discharged from the free end of outlet tube 24*c*. By controlling the relative dimensions of the parts, the proportions of the respective fractions, and the maximum/minimum temperatures of those fractions, may be varied as desired.

Figure 3:
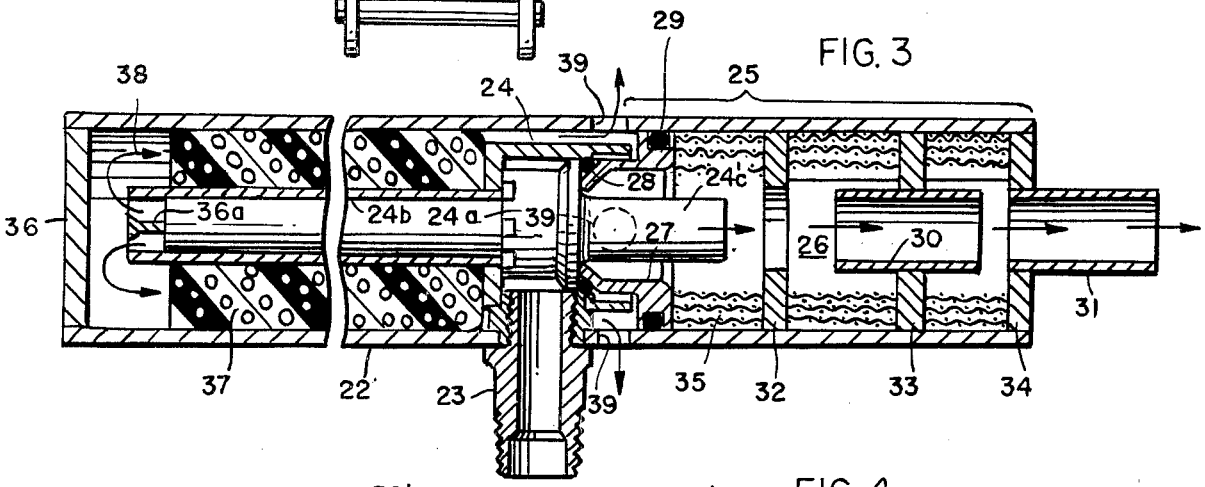
FIG. 3 is a longitudinal sectional view illustrating details of the vortex tube assembly.

A muffler 25 communicates with the cold air outlet 24*c* of the vortex tube, as clearly depicted in FIG. 3. In the illustrated embodiment, the outer shell or casing of the muffler is an integral part of cylindrical tube 22 and constitutes an axial extension thereof. The muffler casing defines a muffler chamber 26 and includes an apertured heat-conductive metal sleeve 27 which projects into the cylindrical generator body 24*a* to maintain the parts in the assembled relation shown and which communicates directly with the cold air outlet of the vortex tube 24. Resilient sealing ring 28 prevents the leakage of compressed air from the generator body, while ring 29 seals against the inner surface of the tubular casing to isolate muffler chamber 26.

Any suitable baffling or packing may be disposed within the muffler chamber to suppress the sound of high-velocity cold air discharged from outlet 24*c*. In the form illustrated, a pair of axially-spaced tubes 30 and 31 are disposed in alignment with the outlet tube 24*c*. Annular baffles 32, 33, and 34 are also axially spaced apart within the chamber with baffle 34 serving as both an end wall for the casing and as a support for tubular discharge nozzle 31.

The chamber 26 may also include a packing or lining 35 of porous heat-conductive material. A metallic screening, rolled into cylindrical form, is shown in FIG. 3, but other porous heat-conductive materials such as metal wool or porous sintered metal elements may be used. The arrangement presented in FIG. 3 has been found effective in substantially reducing the noise associated with the discharge of cold air from vortex tube 24; however, it is to be understood that a greater or smaller number of baffles and re-entrant tubes may be provided and that the packing may be eliminated or substituted for the baffles and re-entrant tubes, all as required or desired for a given application.

At its opposite end, the tubular casing 22 is provided with an end wall 36 spaced axially from the free end of hot air outlet tube 24*b*. It will be noted that the inside diameter of the casing 22 is substantially larger than the diameter of vortex tube 24, and that an annular packing 37 fills the space between hot air outlet tube 24*b* and the inner surface of the casing to muffle the sound of air discharged from the hot air outlet. The packing may be of open-celled foam (as shown) or a mass of natural or synthetic fibers. The packing may also be supplemented, or even replaced, by sound-suppressing baffles similar to baffles 32-34 within muffler chamber 26.

End wall 36 functions as diverting or deflecting means to reverse the direction of flow of hot air discharged from outlet tube 24*b*. Such diverting function may be augmented by any suitable diverting element either carried by the end wall (see FIG. 4) or disposed within the free end of the hot air outlet tube (diverting element 36*a* in FIG. 3). The reversely-directed hot air flows in the direction indicated by arrows 38, sweeps over the generator body 24*a*, impinges on the sleeve 27 of the muffler, and exits laterally from the casing through discharge ports 39. Because the cylindrical casing of muffler 25 is an integral extension of the heat-conductive outer casing 22, heat is also transmitted to the muffler by conduction.

The discharge ports are located adjacent the cold air outlet 24*c* of the vortex tube 24. Whether the discharge ports are located in the wall of the casing within the axial limits of outlet tube 24*c*, or are spaced downstream from the free end of outlet tube 24*c* (sleeve 27 would necessarily be extended in the latter case) depends primarily on the amount of heating required to prevent obstructive icing of the muffler. Thermal conductivity of the casing is also a significant factor; where the casing is formed of aluminum or other highly conductive metal, it has been found that discharge ports 39, when located as shown in FIG. 3, provide sufficient heating of the muffler to prevent icing without, at the same time, excessively heating the muffler and thereby unnecessarily reducing the cooling effectiveness of the vortex tube assembly.

In the embodiment illustrated in FIG. 3, four discharge ports 39 are provided in casing 22; however, a greater or smaller number may be provided as desired. Also while end wall 36 is shown as being imperforate, thereby diverting or redirecting all of the hot air discharged from outlet tube **24*b*, it will be understood that in certain applications wall 36 may be provided with a hot air discharge port, or some other means may be provided for the escape and/or utilization of a portion of the hot air, in which case only a portion of the hot air discharged from outlet tube 24*b* would follow the path of arrows 38**.

From the above, it is believed evident that the casing 22 and end wall 36 function in part as hot air transfer means for redirecting and transmitting at least a portion of the hot air discharged from the hot air outlet of the vortex tube in a reverse direction towards the cold air outlet of that tube and towards the muffler into which the cold air tube discharges, and that such transfer means is in a thermal exchange relation with the muffler to produce the minimal heating of the muffler required to prevent muffler icing, even under continuous operating conditions.

Figure 4:
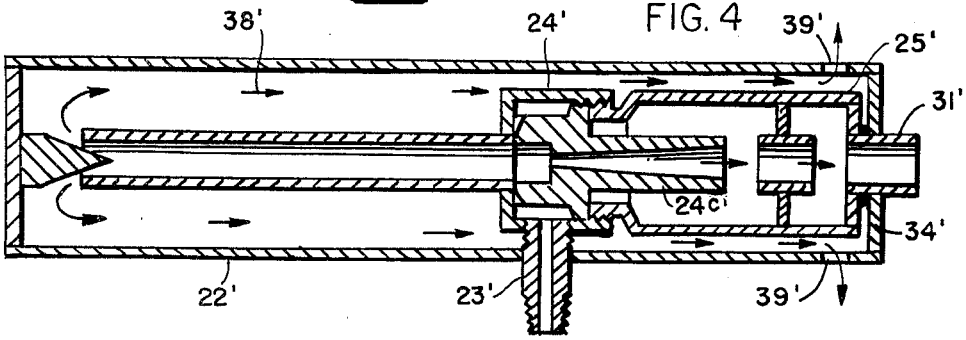
FIG. 4 is a longitudinal sectional view of an alternative construction for the vortex tube assembly.

FIG. 4 depicts a modified construction, the essential difference being that the cylindrical wall 25' of the muffler casing is formed as a separate element rather than as part of tubular casing 22'. Discharge ports 39' are formed in the wall of casing 22' adjacent the end wall 34' of the casing, well beyond the free end of the cold air outlet **24*c*' of vortex tube 24'. As a result, hot air redirected as represented by arrows 38' flows along a substantial length of the wall 25' of the internal muffler. Since it is desirable to heat the muffler only to the extent required to prevent icing, the construction represented in FIG. 4** would be suitable where the construction of the muffler, the materials used in fabricating the assembly, and/or the extremely low temperatures of the air discharged from the cold air outlet of the vortex tube, require the hot air to contact a relatively large area of the surface of the muffler.

While in the foregoing, I have disclosed an embodiment of the invention in considerable detail for purposes of illustration, it will be understood by those skilled in the art that many of these details may be varied without departing from the spirit and scope of the invention.

I claim:

1. An anti-icing noise-suppressing vortex tube assembly comprising a vortex tube having a generally cylindrical generator body provided with a compressed air inlet, a hot air outlet tube projecting from one end of said body, and a cold air outlet tube coaxial with said hot air inlet tube and projecting from the opposite end of said body; a heat-conductive outer tubular casing disposed about said vortex tube; a noise-suppressing muffler having a thermally-conductive tubular muffler casing secured to said outer casing and having noise-suppressing means disposed therein; said muffler casing having an inlet at one end communicating directly with said cold air outlet tube and having a discharge nozzle at the other end thereof coaxial with said muffler inlet; deflecting means provided by said outer casing for redirecting hot air discharged from said hot air outlet tube back through said outer casing toward said muffler, and also causing heating of said conductive outer casing for transmitting heat by conduction to said muffler, for preventing excessive icing of said muffler; said outer casing having a hot air discharge port formed in the wall thereof for the separate discharge of hot air in a direction other than the direction of discharge of cold air from said nozzle.

2. The assembly of claim 1 in which said deflecting means comprises an end wall of said outer casing spaced axially from the end of said hot air outlet tube.

3. The assembly of claims 1 or 2 in which said muffler casing constitutes an axial extension of said outer casing.

4. The assembly of claim 3 in which said muffler casing is formed integrally with said outer casing.

5. The assembly of claim 3 in which said hot air discharge port is located in said outer casing immediately adjacent said muffler casing.

6. The assembly of claims 1 or 2 in which said outer casing has a portion thereof extending axially beyond said cold air outlet of said vortex tube to define a chamber; said muffler being disposed within said chamber and having its tubular casing coaxial with and spaced inwardly from the wall of said tubular outer casing.

7. The assembly of claim 6 in which said hot air discharge port is located in the wall of said portion of said outer casing extending axially beyond said cold air outlet of said vortex tube.

8. The assembly of claim 1 in which said hot air discharge port is located in said outer casing to direct hot air laterally therefrom in a direction generally normal to the direction of discharge of cold air from said nozzle.

9. An anti-icing noise-suppressing vortex tube assembly comprising a vortex tube disposed inside a casing; said vortex tube having a generator body provided with a compressed air inlet and having coaxial and oppositely-directed tubular outlets for hot air and cold air, respectively; a noise muffler disposed downstream from and operatively connected to said cold air outlet for suppressing noise of cold air discharged at high velocity from said cold air outlet and through said muffler; hot air transfer means communicating with said hot air outlet for transmitting at least a portion of the hot air discharged from said hot air outlet in a reverse direction towards said muffler; said transfer means being disposed in thermal exchange relation with respect to said muffler for heating said muffler with said hot air to prevent muffler icing during vortex tube operation; said hot air transfer means being provided by said casing; said casing being tubular and including an end wall spaced axially beyond said hot air outlet for reversing the direction of flow of hot air discharged from said hot air outlet; said tubular casing having inside cross sectional dimensions larger than the outside cross sectional dimensions of said vortex tube to define a longitudinally-extending passage for the reverse flow of hot air towards said muffler; said casing having a portion thereof extending axially beyond said cold air outlet to define a chamber terminating in an end wall having a tubular nozzle for the discharge of cold air; said muffler including sound suppressing elements disposed within said chamber between said cold air outlet of said vortex tube and said nozzle; said muffler also having a tubular outer wall coaxial with said cold air outlet and projecting axially therebeyond; said tubular portion of said casing extending about said wall of said muffler to define an annular space therebetween.

10. The assembly of claim 9 in which said casing is provided with at least one lateral discharge port disposed between said generator body and said nozzle for the discharge of hot air.

11. The assembly of claim 9 in which said casing is formed of heat-conductive material.

* * * * *